United States Patent [19]

Paurat et al.

[11] Patent Number: 4,470,636

[45] Date of Patent: Sep. 11, 1984

[54] MINING MACHINE EXCAVATOR DRUM HAVING LIQUID SPRAY CONTROL

[76] Inventors: Friedrich W. Paurat, Kasselweg 29, 4230 Wesel 1; Roland Paurat, Blumenstr. 11, 4230 Wesel 13, both of Fed. Rep. of Germany

[21] Appl. No.: 334,070

[22] Filed: Dec. 23, 1981

[30] Foreign Application Priority Data

Dec. 24, 1980 [DE] Fed. Rep. of Germany ..... 3049146

[51] Int. Cl.[3] ..... E21C 35/22

[52] U.S. Cl. ..... 299/81; 299/87

[58] Field of Search ..... 299/81, 31, 32, 64, 299/87; 175/91

[56] References Cited

U.S. PATENT DOCUMENTS

| | | | |
|---|---|---|---|
| 2,018,926 | 10/1935 | Schroepfer | 299/81 X |
| 2,495,840 | 1/1950 | Findlater | 299/81 X |
| 3,191,756 | 6/1965 | Paurat | 198/128 |
| 3,297,292 | 1/1967 | Paurat | 248/354 |
| 3,374,033 | 3/1968 | Arentzen | 299/81 |
| 3,729,056 | 4/1973 | Paurat | 173/43 |
| 3,847,439 | 11/1974 | Allen | 299/81 |
| 3,998,493 | 12/1976 | Paurat | 299/56 |
| 4,080,000 | 3/1978 | Paurat | 299/66 |
| 4,095,845 | 6/1978 | Paurat | 299/18 |
| 4,098,539 | 7/1978 | Zitz et al. | 299/89 X |
| 4,173,836 | 11/1979 | Paurat | 37/81 |
| 4,219,239 | 8/1980 | Weikert | 299/81 |
| 4,231,618 | 11/1980 | Paurat | 299/31 |
| 4,247,997 | 2/1981 | Paurat et al. | 37/82 |
| 4,274,675 | 6/1981 | Paurat et al. | 299/31 |
| 4,278,293 | 7/1981 | Paurat | 299/87 X |
| 4,289,357 | 9/1981 | Hintermann | 299/81 |
| 4,367,902 | 1/1983 | Schwarting | 299/81 X |

FOREIGN PATENT DOCUMENTS

| | | | |
|---|---|---|---|
| 2943476 | 7/1981 | Fed. Rep. of Germany . | |
| 2242558 | 3/1975 | France | 299/81 |
| 1414917 | 11/1975 | United Kingdom | 299/81 |

*Primary Examiner*—Ernest R. Purser

*Attorney, Agent, or Firm*—Karl F. Ross; Herbert Dubno

[57] ABSTRACT

A mining machine, e.g. for advancing a mine tunnel against a coal or rock face, comprises an elongated rotary excavator, e.g. in the form of a worm, provided with tools for attacking the face. The excavator is provided with nozzles for spraying a liquid adapted to reduce dust formation, usually water, and the nozzles are divided into angularly spaced zones respectively communicating wth a rotary distributing valve body which delivers the liquid to the group of nozzles trained upon the mine face while blocking flow to the other groups.

4 Claims, 3 Drawing Figures

MINING MACHINE EXCAVATOR DRUM HAVING LIQUID SPRAY CONTROL

FIELD OF THE INVENTION

Our present invention relates to the excavating of mine tunnels and, more particularly, to a machine for excavating a coal or rock face in a mine tunnel and provided with means for reducing the formation of dust and preventing sparking during the process in which the excavator digs away at the face.

BACKGROUND OF THE INVENTION

Mining machines (see U.S. Pat. No. 4,278,293 and the art referred to therein and German Patent Documents Nos. 28 47 909 and 29 43 476) are frequently provided with elongated rotary excavators which are thrust against the face of the tunnel to be advanced or from which mineral matter is to be removed in a direction transverse to the axis of rotation of the excavator which can be provided with a conveyor flight and picks or other tools for eating away the face.

In a coal excavation, the excavator is referred to as a coal auger although similar excavators can be used for recovering other mineral matter from mine tunnels or for advancing a tunnel in a substratum.

It is known to provide such machines with a spraying system or to otherwise spray a liquid upon the rotating excavator so that the dust is dampened and poses less of a danger to moving parts of the machine, is less of a hazard to mine workers and the danger of explosion is minimized.

Machines for this purpose have included nozzles through which a liquid, generally water, was sprayed and which were continuously supplied with water delivered to the rotating member so that the spray was directed not only at the face or region of attack of the tools upon the mineral matter, but also in other directions including rearwardly and downwardly.

The result has been an undesirable wetting of excavated material which has caused compaction and difficulties in removing the excavated material from the tunnel front and has increased the complexity of processing the material, for example, in air classifiers or the like.

It has been proposed to provide the picks forming the tools of an excavating machine directly with respective nozzles and to additionally provide each nozzle with a valve actuated by relative movement of the pick and the excavator body carrying same so that the spray could be confined to the region at which the pick was actually in contact with a rock or coal face. Experience with such machines has shown, however, that they are unreliable and prone to breakdown, while being functionally deficient in the sense that the valve tend to remain open or to close at the wrong times.

OBJECTS OF THE INVENTION

It is the principal object of the present invention to provide a mining machine of the class described which is more reliable and effective than earlier machines and which can overcome the drawbacks of such machines, especially with respect to confining the spray to the region of attack of the tools upon the mining face.

Another object of this invention is to provide a mining machine with an improved rotary excavator or coal auger assembly whereby the aforedescribed disadvantages are obviated.

SUMMARY OF THE INVENTION

These objects and others which will become apparent hereinafter are attained in accordance with the invention by providing, in a mining machine for the excavation of mineral matter from a face of a mining tunnel having a rotary elongated excavating auger, a valve assembly in the region of the axis of rotation of this auger which, moreover, has outwardly trained nozzles distributed around this axis and angularly subdivided into respective groups, each of which has a passage extending to this valve assembly.

The valve assembly is supplied with the spray liquid, generally water, to a fixed valve portion while a rotary valve portion has ports respectively connected to the passages and communicating in turn with the ports of the first valve portion when the corresponding sector of the auger is in position to attack the tunnel face.

Thus only the working part of the auger at any point in time can be supplied with the spray liquid. The working part of the auger is, of course, that portion which is thrust against the tunnel face during normal operation of the machine.

The valve assembly, according to the invention, can comprise an angularly fixed valve body with an outlet port which preferably is widened in the shape of a sector, corresponding to the angular extent of the tool segment to be supplied with the liquid, which is received in a valve sleeve connected to the rotary part of the auger, this sleeve being formed with the ports previously mentioned in communication with the passages. As a result, each of these ports communicates in turn with the sector-shaped outlet port of the valve body.

The outlet port is preferably formed in an end face of the valve body while the nozzle ports are formed in a bottom wall of the valve sleeve.

It has also been found to be advantageous, especially for a coal auger, for the recovery of coal from a seam through which the tunnel is advanced or for a worm-type excavating machine for advancing a tunnel through a subterranean stratum to journal the rotary member on a member of the machine via a planetary speed-reducing transmission including a sun gear, a fixed planet gear carrier, planet gears rotatable on this carrier and a ring gear meshing with the planet gear or gears.

According to the invention the angularly affixed valve body forms part of or is connected to the planet gear carrier which is also formed with a passage for delivering the spray liquid to the aforementioned outlet port.

The tools of the rotary member can include a worm flight and the nozzles can be mounted on the outer periphery of this flight with the passages communicating with the nozzles being formed as bores directly in the flight and extending generally radially therethrough.

With the system of the invention the spray is applied only by the sector of the rotary excavator whose tools then attack the coal and other mineral matter thereby keeping down the dust, preventing the formation of sparks and minimizing the danger of explosion. Excessive dampening of the excavated material is precluded.

BRIEF DESCRIPTION OF THE DRAWING

T e above and other objects, features and advantages of the present invention will become more readily apparent from the following description, reference being made to the accompanying drawing in which.

SPECIFIC DESCRIPTION

Figure 1:
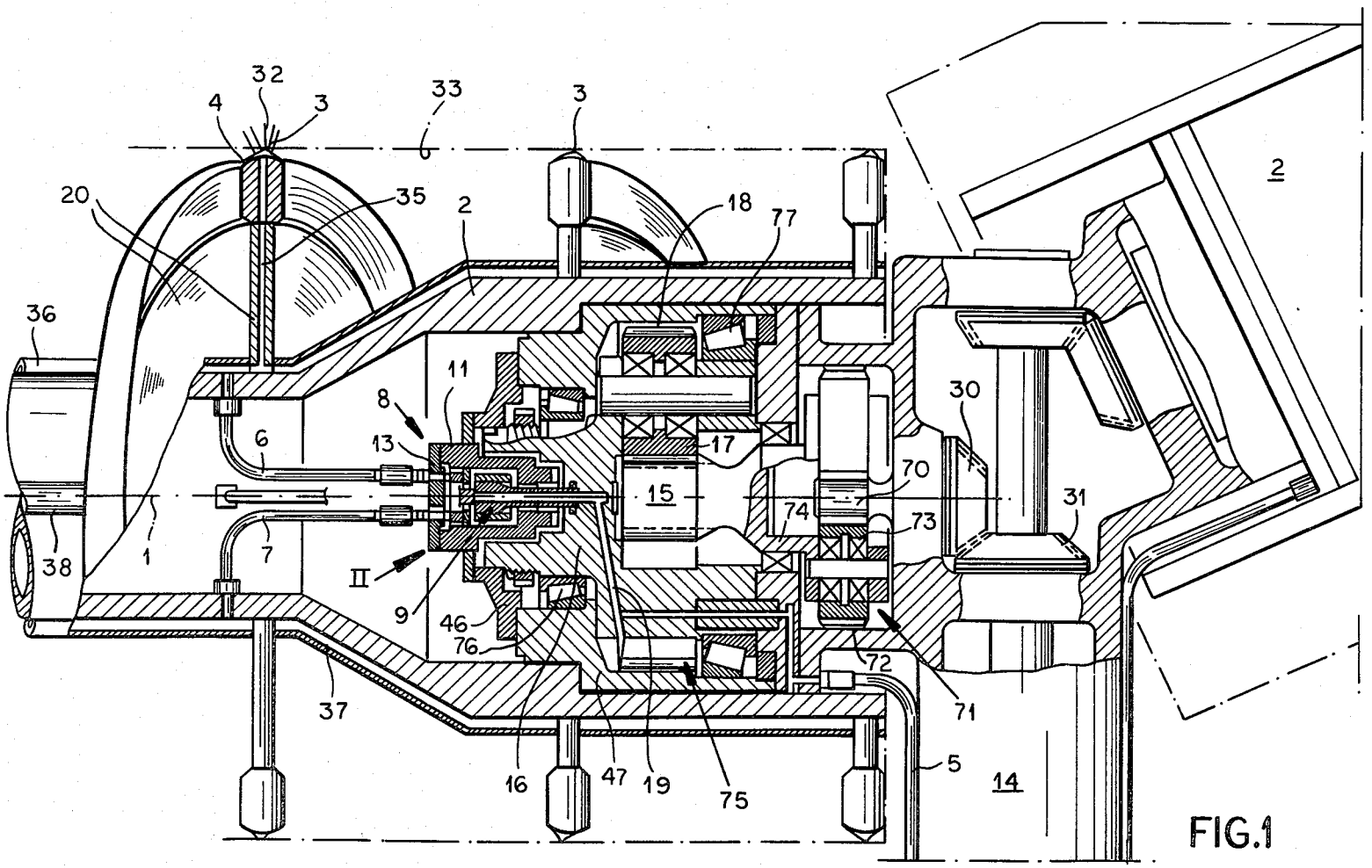
FIG. 1 is a plan view, partly in section, of the drive portion of a rotary excavator such as a coal auger, e.g. of the type described in the aforementioned publications.

The machine to which the system of the present invention can be applied, can be of the type described in the aforementioned publications. Such machines generally comprise a chassis which is advanced through the tunnel, e.g. as it is being excavated, a prime mover generating the power for operating a machine and, apart from the usual shields or the like which can be braced against the walls of the tunnel, can include elongated rotary excavators such as coal auger or worm excavators having a helical flight and provided with picks, teeth or the like for attacking the tunnel face.

In the illustrated construction of the machine, a pair of augers 2 has been shown, each auger being rotatable about an axis 1 and carrying picks 3 along the outer periphery of a conveyor flight 20. One of these augers, shown in greater detail in FIG. 1 than the other, has a bevel gear 30 which is driven by a bevel gear 31 of a drive shaft extending through a tool-carrier column 14 to the motor of the machine.

The picks 3 are each provided with a nozzle 4 forming a nozzle at each pick from which a liquid 32 can be sprayed during the attack of the pick against the tunnel front represented at 33.

Bores 35, drilled directly through the flight 20 radially, deliver the liquid to the nozzles 4.

The liquid is delivered to the tool through tubes 5 from a tank and pump (not shown) flanking the carrier 14.

As is apparent from FIG. 1, auger 2 is subdivided into sectors (in the illustrated case four sectors although more can be provided if desired), each of which has a passage 36, 37, 38, etc. running along the auger body and communicating with all of the bores 35 of the nozzles 4 in the respective sector.

Each of the passages 36, 37, etc. is also provided with a respective tube 6, 7, constituting an extension of this passage, which delivers the liquid to the passages as they are rotated to the working side via a valve assembly 8 disposed in the region of the axis 1 of the machine. This valve assembly is controlled by the rotation of the auger.

Figure 2:
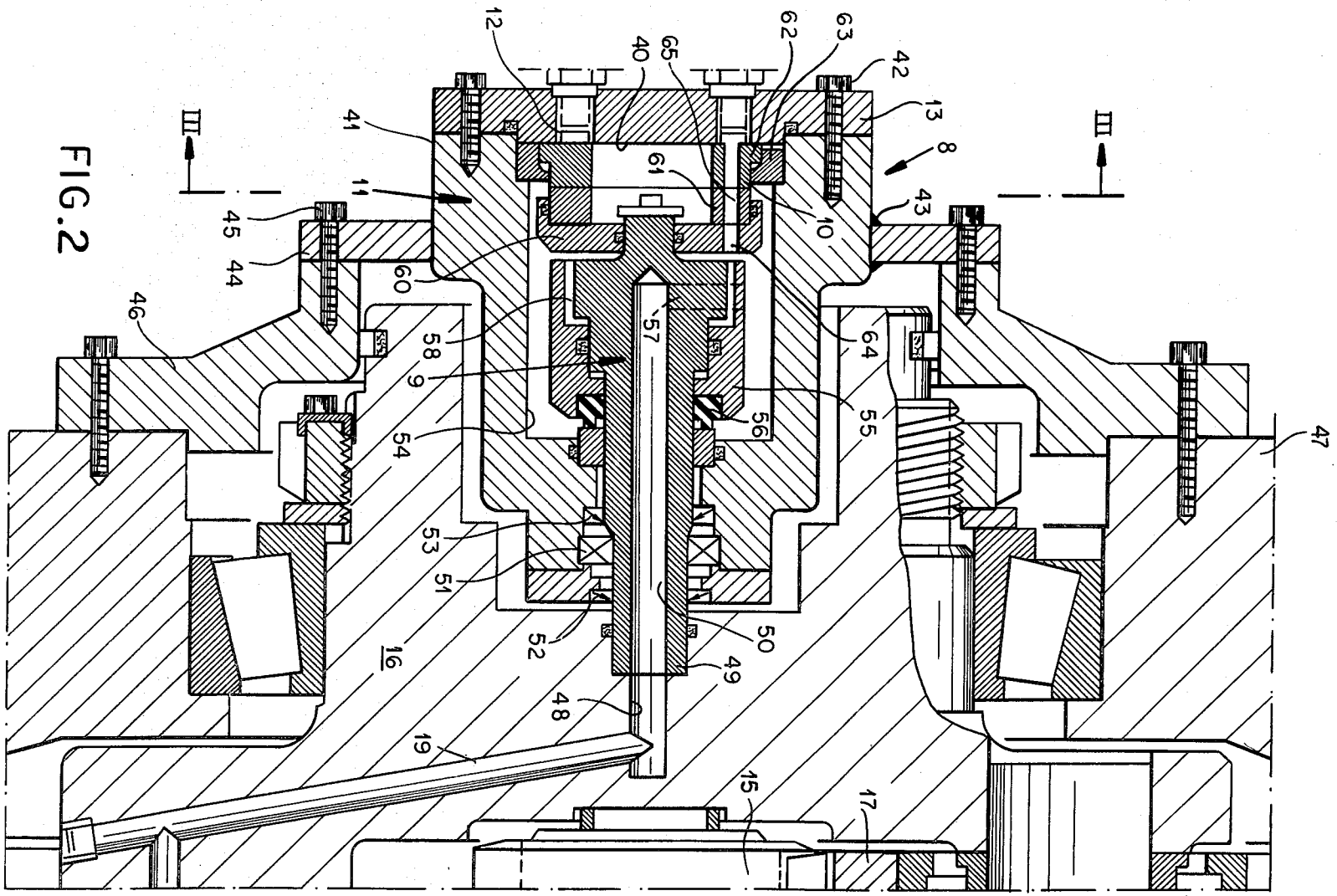
FIG. 2 is a detail view of the portion represented at II of FIG. 1, drawn to a larger scale.

The valve assembly (see FIG. 2) preferably includes a fixed valve body or member 9 and a rotatable valve body or sleeve 11.

More specifically, the tubes 6, 7 open via ports 12 at a bottom wall 40 of the sleeve 11 which comprises a bottom 13 affixed to a stepped sleeve member 41 by bolts 42. The sleeve member 41 is welded to a plate 44 connected by bolts 45 to a flange 46 secured to the body 47 on which the auger 2 is mounted.

The fixed valve body or member 9 comprises a stem 49 which is fitted into the planet carrier 16 to be described in greater detail below and communicates with an axial bore 48 thereof via a passage 50 running through this stem which forms a bearing 51 for the right hand end of the sleeve 11. Seals 52 and 53 flank this bearing.

A chamber 54 within the sleeve 11 is sealed relative to the latter by a packing sleeve 55 and the packing 56.

A radial bore 57 opens into an angular gap 58 between the sleeve 55 and the body 49, this gap opening into the compartment 54.

A cup 60 is fixed to the member 49 so that it does not rotate, this cup receiving a disk 61 bearing upon a disk 62 surrounded by a rotary bearing 43 for the left hand end of the sleeve 11.

Figure 3:
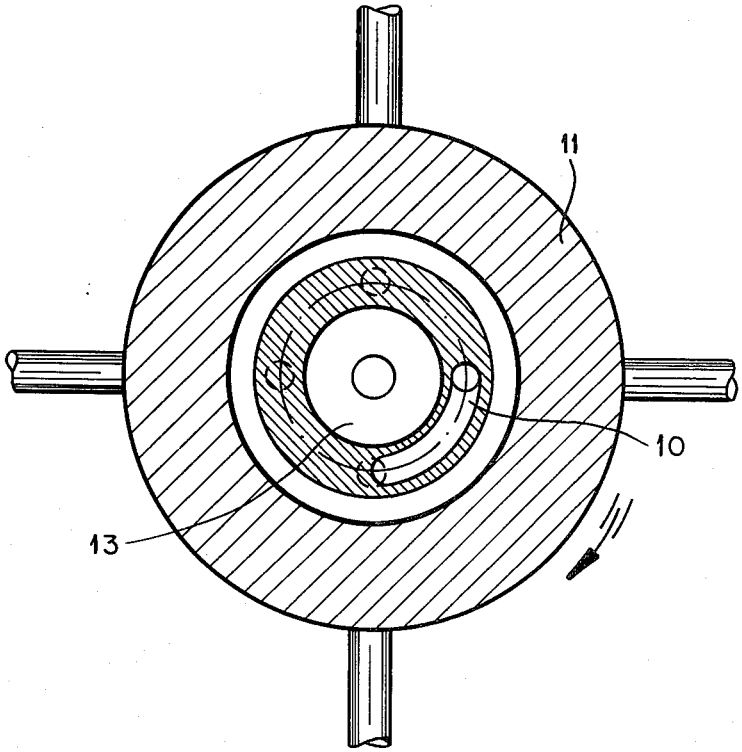
FIG. 3 is a section taken along the line III—III of FIG. 2.

A bore 64 in the cup 60 communicates with a bore 65 in the disk 61 and, through the latter, with a sector-shaped discharge port 10 (see FIG. 3) in te disk 62 which bears upon and confronts the wall 40.

Thus as each port 12 registers with the discharge port 10 upon rotation of the excavator 2, the fluid is delivered to the group of nozzles engaging the face of the tunnel.

The bevel gear 30 drives a sun gear 70 of a first planetary speed-reducing transmission which also includes a ring gear 72 and planet gear 73 on a planet carrier 74.

The planet carrier 74, in turn, drives a second planetary gear transmission 75 which includes a sun gear 15 connected to the planet carrier 16 provided, as previously noted, with the stem 49, planet gears 17 on this carrier and a ring gear 18 fixed to the body 47 and thus to the rotary part of the auger. Combined radial and thrust bearings 76 and 77 rotatably support the body 47 and the planet carrier 16. The latter is formed with a passage 19 connecting the bore 48 with the supply line 5.

We claim:

1. In a mining machine having an elongated excavator provided with a tool-carrying rotatable member adapted to be thrust against a face to be mined in a direction generally transverse to an axis of rotation of said member, and means for spraying a liquid onto material as it is excavated, the improvement wherein said means includes:

outwardly directed nozzles on said member, spaced about and along said axis;

means forming respective passages communicating with the nozzles of the respective angular spaced sectors of said member;

a valve assembly disposed along said axis for selectively connecting each of said passages with a source of liquid to be sprayed as said member rotates the respective sector into working engagement with said face; and a planetary speed-reducing transmission for driving said member, said transmission including a driven sun gear, planetary gears meshing with said sun gear, a planet carrier for said planet gears, and a ring gear meshing with said planet gears, said ring gear being connected to said member and said planet carrier being angularly fixed and formed with a passage communicating with said valve assembly for connecting said source therewith.

2. The improvement defined in claim 1 wherein said planet carrier is connected to a stationary part of said valve assembly, said member being connected to a rotatable part thereof.

3. The improvement defined in claim 1 wherein said member is formed with a worm flight, said nozzles being mounted on said flight and communicating with the respective passages through bores formed directly through said flight.

4. The improvement defined in claim 1 wherein said valve assembly comprises a valve sleeve connected to said member and rotatable therewith, said valve sleeve having a plurality of ports each communicating with a respective one of said passages and angularly spaced about said axis, and a valve body received in said sleeve and having an outlet port connected with said source and successively communicating with said ports of said sleeve upon rotation of said member.

* * * * *